United States Patent [19]

Hyon et al.

[11] Patent Number: 4,765,937

[45] Date of Patent: Aug. 23, 1988

[54] METHOD OF PREPARING HIGH STRENGTH AND MODULUS POLY(VINYL ALCOHOL) FIBERS

[75] Inventors: Suong-Hyu Hyon; Yoshito Ikada, both of Uji, Japan

[73] Assignee: Biomaterials Universe, Inc., Kyoto, Japan

[21] Appl. No.: 28,943

[22] Filed: Mar. 23, 1987

[30] Foreign Application Priority Data

Mar. 24, 1986 [JP] Japan ..... 61-66136

[51] Int. Cl.[4] ..... D10F 6/14

[52] U.S. Cl. ..... 264/185; 264/205; 264/210.8

[58] Field of Search ..... 264/185, 205, 210.8

[56] References Cited

U.S. PATENT DOCUMENTS 4,440,711 4/1984 Kwon et al. ..... 264/185
4,603,083 7/1986 Tanaka et al. ..... 428/364

FOREIGN PATENT DOCUMENTS 0710702 6/1965 Canada ..... 264/185
0723074 12/1965 Canada ..... 264/185

*Primary Examiner*—Joseph L. Schofer
*Assistant Examiner*—J. M. Reddick
*Attorney, Agent, or Firm*—Armstrong, Nikaido, Marmelstein & Kubovcik

[57] ABSTRACT

High strength and modulus fibers are prepared from a poly(vinyl alcohol) solution in a mixed solvent consisting of water and water-miscible organic solvent. Upon extruding the poly(vinyl alcohol) solution into a coagulation bath, gel fibers are formed as a consequence of favorable gel structure with homogeneous net-works. Drawing the gel fibers to an exceedingly high degree leads to formation of poly(vinyl alcohol) fibers which have a superhigh tensile strength and a superhigh modulus.

6 Claims, No Drawings

METHOD OF PREPARING HIGH STRENGTH AND MODULUS POLY(VINYL ALCOHOL) FIBERS

BACKGROUND OF THE INVENTION

The present invention relates to a method of preparing poly(vinyl alcohol) fibers. More particularly, the invention is concerned with a method of preparing high strength and modulus poly(vinyl alcohol) fibers.

Recently, much attention has been paid to development of new high-performance materials, especially, organic polymer materials which are stronger and lighter than metals and ceramics. Among them is the high strength and modulus fiber, which is thought to have high market needs.

So-called Aramid fibers, that is, totally aromatic polyamide fibers, have been industrially produced on the largest scale among the high strength and modulus fibers. However, the Aramid fibers are too expensive to be widely applied and hence development of other high strength and modulus fibers of lower price have strongly been required. Therefore, many attempts have been made to develop such high strength and modulus fibers from high-volume polymers such as polyethylene(PE), polypropylene(PP), polyoxymethylene(POM), and poly(vinyl alcohol)(PVA). Among these non-rigid polymers, PP and POM are relatively low in theoretically attainable modulus because of their spiral chain structure, leading to formation of fibers with low mudulus. On the contrary, PE and PVA are very promising as candidates for high strength and modulus fibers, since they have high theoretically attainable moduli because of their planar zig-zag structure. However, PE fibers may have limited industrial applications because the melting temperature is as low as 130° C., whereas PVA which has the melting temperature as high as 230° C. and is inexpensive in raw material may greatly contribute to industry if high strength and modulus fibers comparable to Aramid fibers can be fabricated from PVA.

Industrially, the PVA fibers have generally been produced by wet spinning from the aqueous solution and widely used in industrial fields. However, the currently produced PVA fibers are quite low in both the strength and the modulus in comparison with Aramid fibers. To enhance the strength and the modulus, organic solutions instead of aqueous solutions have been proposed as the spinning dope. They are (1) glycerine, ethylene glycol, or ethyleneurea solutions from which dry spinning is carried out (Japanese Examined Patent Publication (Tokkyo Kokoku) No. 9768/1962), (2) dimethyl sulfoxide (DMSO) solutions which are wet-spun into organic non-solvents such as methanol, ethanol, benzene, or chloroform (Japanese Unexamined Patent Publication (Tokkyo Kokai) No. 126311/1985), (3) dimethyl sulfoxide solutions from which dry-wet spinning is performed, followed by 20 times drawing of the undrawn fibers (Japanese Unexamined Patent Publication (Tokkyo Kokai) No. 126312/1985), and (4) 2–15% glycerine or ethylene glycol solutions of PVA with a molecular weight higher than 500,000 which are employed as the dope for gel spinning (U.S. Pat. No. 4,440,711/1984).

However, the fibers obtained by the above methods exhibit in all cases a strength lower than 20 g/d and a modulus lower than 480 g/d, being by far inferior to the Aramid fibers. Thus, no work has hitherto been reported that uses spinning dopes made from a mixture of an organic solvent and water with an appropriate mixing ratio as described in the present invention. As mentioned above, the spinning dopes which have been used for fabrication of high strength and modulus PVA fibers are prepared from a single organic solvent such as glycerine, ethylene glycol, and dimethyl sulfoxide, or from a mixed solvent of an organic solvent and another organic solvent, not water.

The key factor for fabrication of superhigh strength and modulus fibers from non-rigid polymers such as PE, PP, POM, or PVA is how to extend and orient the folded chains along the fiber axis to a very high degree. Through intensive works the researchers of this invention have finally found out that superhigh strength and modulus PVA fibers can be produced by spinning from the dopes of an organic solvent and water mixture having an appropriate mixing ratio.

SUMMARY OF THE INVENTION

In view of the above, an object of the present invention is to provide high strength and modulus PVA fibers which have a tensile strength higher than 15 g/d, a tensile modulus higher than 300 g/d, a density at 30° C. higher than 1.315 g/cm$^3$, d-lattice spacings of (100) plane and (001) plane smaller than 7.830Å and 5.500Å, respectively (determined by wide-angle X-ray diffraction), a melting temperature than 240° C. (determined by differential scanning calorimetry(DSC), the end of the melting peak of DSC curves), and a heat of fusion ($\Delta H$) higher than 20 cal/g (determined by DSC). The above object can be achieved upon drawing the fibers obtained by dry, wet, or dry-wet spinning of the PVA dissolved in a mixed solvents of an organic solvent and water with a mixing ratios of water to the organic solvent ranging from 90:10 to 10:90 by weight.

DETAILED DESCRIPTION

The degree of saponification of PVA to be used in this invention should be higher than 95% by mole, preferably 97% by mole and most preferably higher than 99% by mole. If PVA has a degree of saponification, for instance, lower than 85% by mole, the fibers obtained from the PVA exhibit no high strength and modulus. The viscosity-average degree of polymerization of PVA to be used in this method should be higher than 1,000, preferably 1,700. The commercially available PVA with the degrees of polymerization ranging from 1,500 to 3,000 is recommended, as the fiber strength becomes lower with the decreasing degree of polymerization. If a fiber of higher strength, higher moduli or higher resistance against hot water is desired, it is recommended to use PVA with high degrees of polymerization ranging from 5,000 to 20,000 or PVA rich in syndiotactic or isotactic structure.

The organic solvent to be mixed with water in this invention should be compatible with water, preferably miscible with water at any mixing ratio. The recommended organic solvents include acetone, methyl alcohol, ethyl alcohol, n-propyl alcohol, iso-propyl alcohol, aminoethyl alcohol, phenol, tetrahydrofuran, dimethyl formamide, glycerine, ethylene glycol, propylene glycol, triethylene glycol, and dimethyl sulfoxide. Of these organic solvents, dimethyl sulfoxide is the most preferable because of its high solubility for PVA, high PVA stability in its solution, and a desirable dependence of the freezing point depression on the mixing ratio of water to dimethyl sulfoxide. As the mixing ratio of water to these organic solvents largely governs the gel formation, the mixing ratio should be carefully chosen according to the application purpose of the fiber. In general, the water:organic solvent ratio ranges from 90:10 to 10:90 by weight, preferably from 70:30 to 10:90 by weight. Spinning is possible even from a 100% dimethyl sulfoxide solution of PVA, but it is almost impossible to draw the spun fiber to a very high degree.

In order to carry out the method of manufacturing fibers of high strength and modulus in accordance with the invention, a PVA solution is first prepared at a PVA concentration from 2 to 50% by weight. The concentration is chosen according to the required spinning temperature and the draw ratio of the fiber. Such highly concentrated solutions can be readily prepared by raising the temperature of the mixture from PVA and the solvent under stirring or by the use of autoclave or high-frequency heater.

Spinning is carried out using the completely dissolved PVA solution with dry, wet, or the combined dry-wet spinning method. Any of these three spinning methods is applicable in this invention. In the case of dry spinning, the temperature near the spinning nozzle is preferably in the range of 40° to 60° C., where the PVA solution sets to a gel to enable the resulting fiber to be drawn in air to a draw ratio higher than 10. Moreover, further drawing is possible in a coagulation bath like acetone and methyl alcohol. The temperature near the nozzle at the dry-wet spinning ranges from 60° to 90° C. and the PVA solution is extruded into a coagulation bath of acetone, methyl alcohol, ethyl alcohol, or butyl alcohol immediately after coming out from the nozzle holes. The temperature of the coagulation bath where the fiber drawing is carried out is very important and preferably should be kept below room temperature below which the PVA solution immediately after spinning sets to a gel in a short period of time. As gel structure is more readily formed at lower temperatures, the fiber coagulation and drawing is recommended to be performed at a temperature below 0° C., preferably lower than −20°C. It is also possible to extrude the PVA dope into methyl alcohol to form a gel fiber, followed by winding the undrawn fiber under no tension. After drying the gel fiber in air, it is subjected either to dry heat drawing in air or an inert gas, or to wet heat drawing in a silicone oil or polyethylene glycol bath. The draw ratio is 20 to 200 in both cases. The drawn fiber is further subjected either to dry heat drawing in air at a temperature ranging from 140° to 220° C., preferably from 180° to 220° C., or to wet heat drawing to yield superhigh strength and modulus PVA fibers. If necessary, the fibers are heat-treated at a temperature between 200° and 240° C. Wet spinning also provides such superhigh strength and modulus PVA fibers.

The outstanding feature of this invention is to employ a mixture from an organic solvent and water as the solvent for preparing the spinning dope. This solvent for the dope can be also prepared from three kinds of solvents, for instance, by an addition of a volatile solvent such as ethyl alcohol and acetone to the above two-component mixed solvent, since removal of less volatile organic solvents is difficult. It is also possible to use as the coagulant a mixture from an alcohol and dimethyl sulfoxide or an alcohol containing an inorganic compound like calcium chloride.

The PVA fibers obtained by this invention are excellent in their mechanical and thermal properties. A plausible mechanism for formation of high strength and modulus fibers is explained as follows. When the homogeneous solution obtained by complete dissolution of PVA in a mixed solvent from an organic solvent and water at a high temperature around 100° to 120° C. is cooled, the PVA chains undergo mobility reduction and heterogeneous distribution in the solution, resulting in formation of small nuclei due to local chain aggregation through secondary bonding. As a result the solution sets to a gel. Spinning under formation of this network gel structure may realize very high drawing, very high chain orientation along the fiber axis, and formation of extended chain crystals to yield superhigh strength and modulus fibers with high heat resistance as well as high resistance against hot water. On the contrary, the conventional gel spinning using dopes prepared from a single organic solvent does not make possible very high drawing because of insufficient formation of three-dimensional gel structure. However, as mentioned above, the spinning described in this invention uses the dopes prepared from a mixed solvent of an organic solvent and water having an appropriate mixing ratio. As a consequence, the PVA chains in solution may be expanded to a high degree and hence can produce the gel structure with homogeneous net-works, when the PVA solubility is reduced, for instance, by lowering the solution temperature. Exceedingly high drawing, realized by the favorable gel structure, may also lead to formation of PVA crystalline structure with compact lattice spacing, high crystallinity, and large lamella size.

The high strength and modulus fibers obtained by this invention is applicable for the tire cord of radial tires, the bullet-proof jacket, the motor belt, the rope for ship mooring, the tension member for optical fibers, the asbestos substitute fiber, the reinforcing fiber for FRP, and the textile for furnitures.

The present invention is more specifically described and explained by means of the following Examples. It is to be understood that the present invention is not limited to the Examples and various changes and modifications may be made in the invention without departing from the spirit and scope thereof.

EXAMPLE 1

To a powdered PVA with the degree of saponification of 99.8% by mole and the three different viscosity-average degrees of polymerization, the mixed solvents described in TABLE 1 were added so as to have a 15% (by weight) PVA concentration. Homogeneous PVA solutions were obtained upon heating the mixture for 2 hrs in $N_2$ atmosphere at 110° C. and were employed as the spinning dope. Dry and dry-wet spinning were performed by extruding this dope from a nozzle having a hole size of 0.5 mm and a hole number of 16. In the case of drv spinning, the dope was extruded at 40° to 60° C., followed by winding in a heat chamber with circulating hot air (100° to 150° C., 500 l min) at a winding rate of 500 to 1,000 m/min. The fibers obtained in this way were washed with acetone to remove the remaining solvent and then drawn in an air bath kept at 180° C. to a draw ratio higher than 5. In the case of dry-wet soinnino, the dope was extruded at 60° to 90° C. first into air and then immediately into methanol to obtain undrawn gel fibers. Following winding, the fibers were dried in air and then drawn in hot air at 160° to 200° C. to a draw ratio higher than 10. Various PVA fibers were prepared by this procedure and their tensile strength, tensile modulus, density, crystalline lattice spacing, melting temperature, and heat of fusion were determined according to the following measurement conditions. The results of dry and dry-wet spinning are summarized in TABLES 2 and 3, respectively.

[Tensile strength and modulus]

The strength and the modulus of fibers were measured at a tensile speed of 20 mm/min, 25° C., and relative humidity(RH) of 65% using Tensilon/UTM-4-100 manufactured by Toyo-Baldwin Co.

[Density]

The density of dried fibers was measured at 30° C. with a density-gradient tube consisting of benzene and carbon tetrachloride. Prior to the density measurement, the fiber was degassed in benzene for 30 mins.

[Crystalline lattice spacing]

The X-ray diffraction pattern of fibers was taken at a camera distance of 114.6 mm using Ni-filtered Cu-K$\alpha$ with an X-ray diffraction apparatus (Ru-3) of Rigaku-denki Co. The crystalline lattice spacing was corrected using the diffraction angle-lattice spacing relationship for NaF crystal which was placed close to the fiber specimens when they were photographed. The error in reading was ±0.002°.

[Melting temperature and heat of fusion]

The melting temperature and the heat of fusion were measured for fibers weighing 3 to 4 mg in $N_2$ with a differential scanning calorimeter, DSC 1-B, manufactured by Perkin Elmer Inc. Correction of the melting temperature and the heat of fusion was made using indium of 99.99% purity as the standard.

TABLE 1

| Experiment No. | Degree of Polymerization | Composition of Solvent | Mixing Ratio (by weight) |
|---|---|---|---|
| 1 | 1,750 | Water: Dimethyl sulfoxide | 2:8 |
| 2 | 1,750 | Water:Ethylene glycol | 4:6 |
| 3 | 1,750 | Water:Glycerine | 5:5 |
| 4 | 2,400 | Water:Dimethyl sulfoxide | 2:8 |
| 5 | 2,400 | Water:Ethylene glycol | 4:6 |
| 6 | 2,400 | Water:Glycerine | 5:5 |
| 7 | 4,600 | Water:Dimethyl sulfoxide | 2:8 |
| 8 | 4,600 | Water:Ethylene glycol | 4:6 |
| 9 | 4,600 | Water:Glycerine | 5:5 |

TABLE 2

| Experiment No. | Tensile Strength (g/d) | Tensile Modulus (g/d) | Density (g/cm$^3$) | Lattice Spacing (Å) (100) | Lattice Spacing (Å) (001) | Melting Temp. (°C.) | Heat of Fusion (cal/g) |
|---|---|---|---|---|---|---|---|
| 1 | 19 | 320 | 1.316 | 7.763 | 5.470 | 243 | 23 |
| 2 | 16 | 313 | 1.315 | 7.821 | 5.490 | 240 | 21 |
| 3 | 15 | 305 | 1.315 | 7.830 | 5.500 | 241 | 20 |
| 4 | 23 | 416 | 1.319 | 7.761 | 5.463 | 245 | 25 |
| 5 | 19 | 380 | 1.316 | 7.802 | 5.480 | 242 | 22 |
| 6 | 16 | 329 | 1.317 | 7.810 | 5.477 | 241 | 22 |
| 7 | 28 | 460 | 1.321 | 7.759 | 5.430 | 248 | 26 |
| 8 | 24 | 442 | 1.318 | 7.764 | 4.484 | 244 | 21 |
| 9 | 18 | 428 | 1.317 | 7.792 | 5.493 | 242 | 23 |

TABLE 3

| Experiment No. | Tensile Strength (g/d) | Tensile Modulus (g/d) | Density (g/cm$^3$) | Lattice Spacing (Å) (100) | Lattice Spacing (Å) (001) | Melting Temp. (°C.) | Heat of Fusion (cal/g) |
|---|---|---|---|---|---|---|---|
| 1 | 20 | 322 | 1.316 | 7.762 | 5.468 | 243 | 24 |
| 2 | 16 | 310 | 1.316 | 7.820 | 5.485 | 241 | 21 |
| 3 | 16 | 307 | 1.315 | 7.825 | 5.500 | 240 | 21 |
| 4 | 23 | 425 | 1.319 | 7.760 | 5.461 | 244 | 26 |
| 5 | 17 | 380 | 1.315 | 7.802 | 5.478 | 241 | 23 |
| 6 | 18 | 339 | 1.316 | 7.812 | 5.475 | 241 | 21 |
| 7 | 29 | 473 | 1.322 | 7.757 | 5.428 | 249 | 28 |
| 8 | 26 | 459 | 1.318 | 7.762 | 5.483 | 245 | 22 |
| 9 | 20 | 460 | 1.318 | 7.791 | 5.492 | 244 | 25 |

COMPARATIVE EXAMPLE 1

To a powdered PVA with the degree of saponification of 99.8% by mole and the viscosity-average degree of polymerization of 2,400, the single solvents described in TABLE 4 were added so as to have a PVA concentration of 15% by weight. Dry-wet spinning was carried out using this dope, similar to EXAMPLE 1. The solvent remaining in the spun fibers was removed by methyl alcohol washing and air drying. The fibers could be drawn in air at 180° C. to a draw ratio of 4 at highest. TABLE 5 gives their tensile strength, tensile modulus, density, lattice spacing, melting temperature, and heat of fusion.

TABLE 4

| Comparative Experiment No. | Solvent | Degree of Polymerization | Concentration (% by weight) |
|---|---|---|---|
| 1 | Dimethyl Sulfoxide | 2,400 | 15 |
| 2 | Ethylene glycol | 2,400 | 15 |
| 3 | Glycerine | 2,400 | 15 |

TABLE 5

| Comparative Experiment No. | Tensile Strength (g/d) | Tensile Modulus (g/d) | Density (g/cm$^3$) | Lattice Spacing (Å) (100) | Lattice Spacing (Å) (001) | Melting Temp. (°C.) | Heat of Fusion (cal/g) |
|---|---|---|---|---|---|---|---|
| 1 | 13 | 280 | 1.314 | 7.835 | 5.510 | 239 | 19 |

TABLE 5-continued

| Comparative Experiment No. | Tensile Strength (g/d) | Tensile Modulus (g/d) | Density (g/cm³) | Lattice Spacing (Å) (100) | Lattice Spacing (Å) (001) | Melting Temp. (°C.) | Heat of Fusion (cal/g) |
|---|---|---|---|---|---|---|---|
| 2 | 11 | 275 | 1.309 | 7.852 | 5.533 | 237 | 17 |
| 3 | 10 | 263 | 1.312 | 7.903 | 5.608 | 235 | 17 |

EXAMPLE 2

Dopes for spinning were prepared by dissolving two kinds of PVA with the degree of saponification of 99.9% by mole at 110° C. in a mixed dimethyl sulfoxide-water (80:20, by weight) solvent. The one PVA has the degree of polymerization of 4,600 and the PVA concentration of 8% by weight, while the other PVA has the degree of polymerization of 12,000 and the PVA concentration of 3% by weight. Dry-wet spinning was performed by extruding these dopes from a nozzle having a hole size of 0.5 mm and a hole number of 16 into a mixed dimethyl sulfoxide-methyl alcohol (10:90, by weight) coagulant to give undrawn PVA fibers. Following removal of dimethyl sulfoxide and water from the undrawn fibers, they were winded, dried, and then subjected to two-step heat drawing in a silicone oil bath. The first and the second drawing were carried out at 140° and 200° C., respectively. The total draw ratios, which were 90% of the maximum, are given in TABLE 9.

TABLE 6

| Experiment No. | Degree of Polymerization | Draw Ratio | Tensile Strength (g/d) | Tensile Modulus (g/d) | Density (g/cm³) | Lattice Spacing (Å) (100) | Lattice Spacing (Å) (001) | Melting Temp. (°C.) | Heat of Fusion (cal/g) |
|---|---|---|---|---|---|---|---|---|---|
| 10 | 4,600 | 60 | 25 | 450 | 1.317 | 7.760 | 5.455 | 246 | 27.0 |
| 11 | 4,600 | 80 | 28 | 490 | 1.321 | 7.758 | 5.430 | 248 | 28.5 |
| 12 | 12,000 | 80 | 29 | 495 | 1.323 | 7.755 | 5.427 | 251 | 28.6 |
| 13 | 12,000 | 120 | 33 | 545 | 1.332 | 7.743 | 5.425 | 254 | 28.9 |

What we claim is:

1. A method of preparing high strength and modulus poly(vinyl alcohol) fibers, comprising the steps:

(a) forming a solution of poly(vinyl alcohol) in a mixed solvent from an organic solvent and water having a mixing ratio ranging from 90:10 to 10:90 (organic solvent:water) by weight, (b) extruding the solution with dry, wet, or the combined dry-wet spinning method to yield fibers, (c) drawing the fibers.

2. The method of claim 1, wherein the organic solvent is compatible with water.

3. The method of claim 1, wherein the degree of polymerization and the degree of saponification of poly(vinyl alcohol) are higher than 1,000 and 98% by mole, respectively.

4. The method of claim 1, wherein the poly(vinyl alcohol) concentration of the poly(vinyl alcohol) solution is in the range of 2 to 30% by weight.

5. The method of claim 1, wherein the organic solvents are dimethyl sulfoxide, glycerine, ethylene glycol, propylene glycol, triethylene glycol, dimethylformamide, methyl alcohol, ethyl alcohol, acetone, tetrahydrofuran, aminoethyl alcohol, phenyol, n-propyl alcohol, iso-propyl alcohol.

6. The method of claim 1, wherein the draw ratios are higher than 10 for dry heat drawing and higher than 40 for wet heat drawing.

* * * * *